United States Patent [19]

Ruf et al.

[11] 4,025,366

[45] May 24, 1977

[54] METHOD OF MAKING ROTARY PISTON ENGINE CAST IRON INTERIOR SEALS BY QUENCH HARDENING

[75] Inventors: Max Ruf, Obereisesheim; Johannes Steinwart, Bad Friedrichshall II, both of Germany

[73] Assignees: Audi NSU Auto Union Aktiengesellschaft, Neckarsulm; Wankel GmbH, Lindau, Bodensee, both of Germany

[22] Filed: Aug. 22, 1975

[21] Appl. No.: 606,877

Related U.S. Application Data

[62] Division of Ser. No. 433,904, Jan. 16, 1974, abandoned.

[30] Foreign Application Priority Data

Jan. 17, 1973 Germany ..... 2302119

[52] U.S. Cl. ..... 148/3; 75/130 R; 148/35; 148/138; 148/141; 418/178

[51] Int. Cl.[2] ..... B22D 25/00; C21D 5/00; F01C 21/00

[58] Field of Search ..... 418/121, 142, 178; 148/3, 35, 138, 148, 150, 141; 164/114, 128; 75/65 EB, 130

[56] References Cited

UNITED STATES PATENTS

| | | | |
|---|---|---|---|
| 3,171,590 | 3/1965 | Bentele et al. | 418/142 |
| 3,518,128 | 6/1970 | Takao et al. | 148/3 |
| 3,575,537 | 4/1971 | Yamamoto et al. | 418/178 |
| 3,647,577 | 3/1972 | Gomada et al. | 148/35 |
| 3,658,451 | 4/1972 | Gomada | 418/178 |
| 3,673,004 | 6/1972 | Dumitrescu | 148/3 |
| 3,694,194 | 9/1972 | Mirjanic | 148/35 |
| 3,712,767 | 1/1973 | Beutter | 418/121 |

*Primary Examiner*—Walter R. Satterfield
*Attorney, Agent, or Firm*—Kane, Dalsimer, Kane, Sullivan and Kurucz

[57] ABSTRACT

An interior seal for rotary piston engines in the form of a cast iron scraper ring is arranged for axial movement in an annular groove in one face of the piston; and an annular scraping edge of the seal slides along the interior surface of the neighboring end wall of the housing.

3 Claims, 2 Drawing Figures

METHOD OF MAKING ROTARY PISTON ENGINE CAST IRON INTERIOR SEALS BY QUENCH HARDENING

This is a division of application Ser. No. 433,904 filed Jan. 16, 1974 and now abandoned.

BACKGROUND OF THE INVENTION

In order to reduce wear on the scraping edge of scraper rings employed as interior seals for rotary piston engines, it has been proposed to apply to the external face of the ring, including the scraping edge, a chromium layer. Alternatively, the radially innermost bounding surface of the ring, at least in the zone nearest the associated part of the housing has been provided with a hard abrasion-resistant layer, preferably of chromium.

It has been found that there is always the problem of retention of this wear-resistant layer on the base material because it may not withstand the loads applied, so that it may subsequently crumble off. Besides, chrome cladding processes that are normally employed are costly, particularly as a porefree chromium texture is required.

SUMMARY OF THE INVENTION

The object of the invention is to provide an interior seal in the form of a scraper ring whose annular scraping edge is produced at lower cost; and with sufficient hardness without the risk of crumbling; and for this purpose, the annular scraping edge of the ring has a ledeburitic structure produced with comparative ease by known processes, as for example a liquidation technique.

The scraper ring preferably consists of low-phosphorus and sulfur gray cast iron with fine-grained graphite. By heating the scraper ring in the region of the scraping edge of the melting temperature of the cast iron and then cooling rapidly, a ledeburitic structure is formed in this region, adjoined by a martensitic structure. Because the hardness of the scraping edge is brought about by a transformation of structure, as distinct from a subsequently applied layer as in the prior art, there is no danger that the scraping edge will crumble.

The fusion hardening may be accomplished by heating with an electric arc under protective gas or alternatively by means of electron or laser beam techniques. With such processes, no special measures are required for subsequent cooling, because the heating is locally confined, and the rapid cooling needed to achieve the ledeburitic structure is sufficiently promoted by conduction of heat in the base material.

The production of a ledeburitic structure in the region of the scraping edge may alternatively be achieved by centrifugal casting of the scraper ring, with abrupt cooling of the melt in the mold in the region of what is to be the scraping edge.

Fusion hardening may be effected radially, i.e., in the region of the radially innermost peripheral surface of the scraper ring, or axially, i.e. in the region of the axially outermost face of the scraper ring. In fusion hardening, one edge cannot be treated by itself, because it will melt away. Under these circumstances, the scraper ring is first produced with axial and/or radial oversize in the region of the contemplated scraping edge. Thereafter, the fusion hardening is carried out, preferably on a lenticular cross-section. Then the surfaces of the scraper ring adjoining the future scraping edge are finished to form the scraping edge.

BRIEF DESCRIPTION OF THE DRAWINGS:

Examples of the practice of the invention will now be described with reference to the drawings.

DETAILED DESCRIPTION OF THE PREFERRED EMBODIMENT

Figure 1:
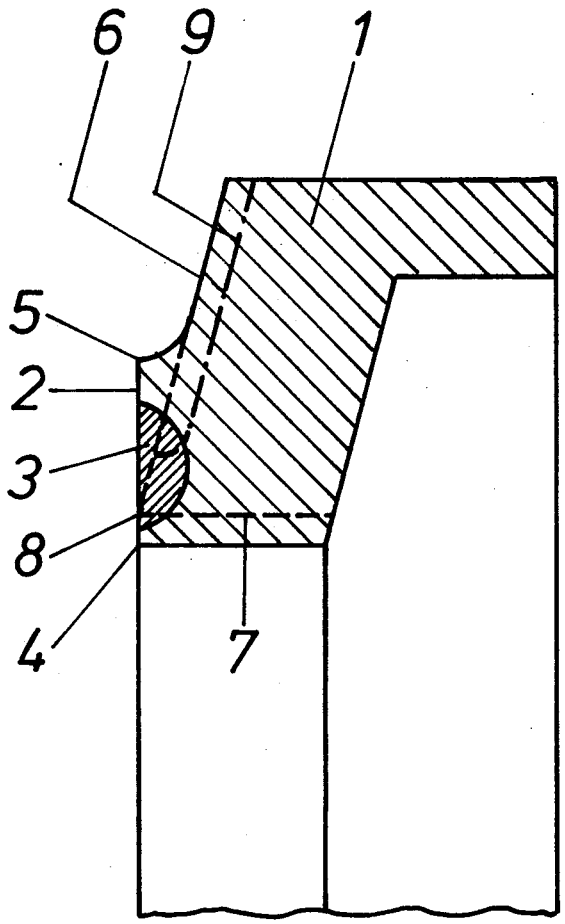
FIG. 1 shows a section of a scraper ring according to the invention after remelting of the region of the future scraping edge, but before finishing.

In FIG. 1, a cast iron blank 1 is shown more or less L-shaped in cross-section. Its axially outermost face 2 includes a zone 3 consisting of a ledeburitic structure produced by remelting. The radial elevation of this zone is for example 1mm, its depth about 0.5 mm. As may be seen the zone 3 does not extend to the edges 4 and 5 of face 2, to prevent the melt from draining off. After the remelting operation, the blank is machined down to the finished surfaces 6 and 7, shown dotted, so that a sharp, hard scraping edge 8 is formed.

In order to keep the radial extent of the scraping edge as small as possible even when worn, the finishing can be continued as far as the dot-dash line 9.

Figure 2:
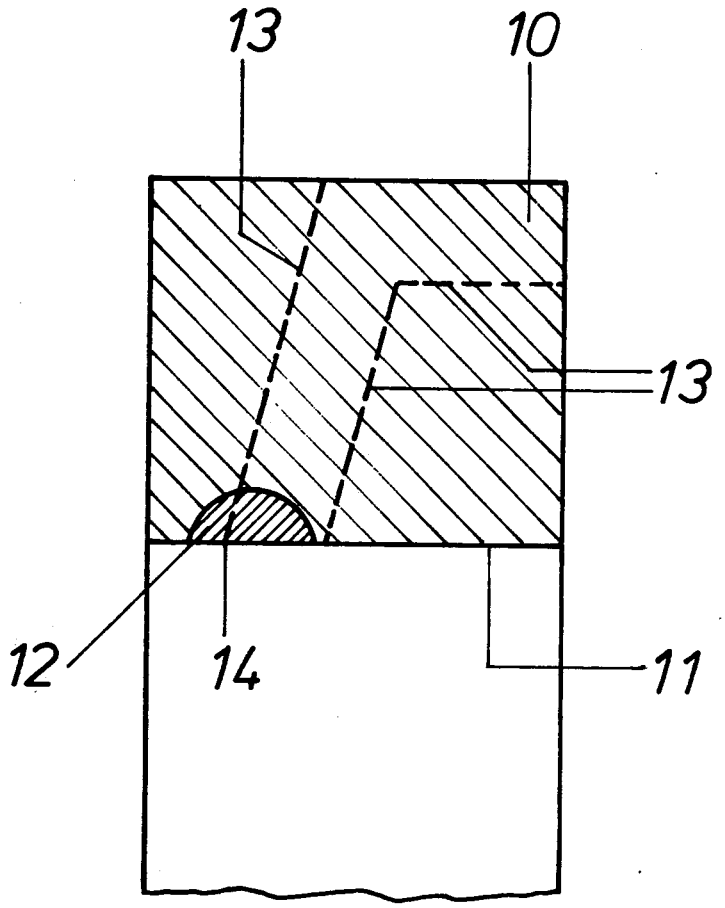
FIG. 2 shows a section similar to FIG. 1 for an alternative embodiment.

In the example of the embodiment of FIG. 1, the fusion hardening is axial whereas in the example of the embodiment of FIG. 2 radial fusion hardening is employed. The blank casting 10 may be a ring of rectangular cross-section. Its radially innermost peripheral surface 11 has a zone 12 of ledeburitic structure produced by remelting in the region of the contemplated scraping edge. In order to fabricate the scraper ring, the blank 10 is ground or turned down to the surfaces 13, shown dotted, again forming a hard and sharp scraping edge 14.

The invention is, of course, not limited to the embodiments shown. In particular other cross-sectional shapes of scraper rings may be used. The radial fusion hardening of FIG. 2 may also be applied to a scraper ring blank of FIG. 1.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A method for fabricating an interior seal for rotary piston engines, in the form of a cast iron scraper ring arranged axially movable in an annular groove in an end face of the piston and having an annular scraping edge adapted to slide in sealing contact along the interior surface of the adjacent end wall of a housing, said annular scraping edge having a ledeburitic structure, comprising the steps of; forming a scraper ring blank of cast iron with a working face, providing an annular forming zone in the working face spaced from both ends thereof and positioned to include the location of the ultimate scraping edge, heating the face of the scraper ring blank along the annular zone to the melting temperature of the cast iron, cooling the melting zone so rapidly a ledeburitic structure is formed, and finishing the scraper ring to produce the scraper edge within the location of the annular zone.

2. The invention in accordance with claim 1 wherein the heating is effected by means of electric arcs under protective gas.

3. The invention in accordance with claim 1 wherein the heating is effected by means of an electron or laser beam.

* * * * *